US005818003A

United States Patent [19]

Moldovan et al.

[11] Patent Number: 5,818,003

[45] Date of Patent: Oct. 6, 1998

[54] ELECTRIC SWITCH WITH ARC CHUTE, RADIALLY CONVERGING ARC SPLITTER PLATES, AND MOVABLE AND STATIONARY ARC RUNNERS

[75] Inventors: Peter K. Moldovan, Cascade; Englebert Hetzmannseder, Shorewood; Earl T. Piber, Oconomowoc; Jeffery A. Patten, Lake Mills, all of Wis.

[73] Assignee: Eaton Corporation, Cleveland, Ohio

[21] Appl. No.: 598,454

[22] Filed: Feb. 8, 1996

[51] Int. Cl.[6] ..... H01H 9/30; H01H 33/04

[52] U.S. Cl. ..... 218/26; 218/30; 218/34; 218/38; 218/36; 218/40; 218/151

[58] Field of Search ..... 218/22–26, 30, 218/31, 34, 36, 37–39, 40, 146–151; 335/16, 201, 202

[56] References Cited

U.S. PATENT DOCUMENTS

| | | | |
|---|---|---|---|
| 3,178,544 | 4/1965 | Mayer | 218/22 X |
| 3,307,004 | 2/1967 | Bottonari et al. | 218/22 |
| 3,515,829 | 6/1970 | Hurtle et al. | 218/31 |
| 4,375,021 | 2/1983 | Pardini et al. | 218/25 |
| 4,387,281 | 6/1983 | Haury et al. | 218/27 |
| 4,451,718 | 5/1984 | Yamagata et al. | 218/23 |
| 4,568,805 | 2/1986 | Wycklendt et al. | 218/38 |
| 4,598,187 | 7/1986 | Howell | 218/32 |
| 4,616,198 | 10/1986 | Pardini | 335/16 |
| 4,743,720 | 5/1988 | Takeuchi et al. | 218/24 |
| 5,004,874 | 4/1991 | Theisen et al. | 218/151 |
| 5,130,504 | 7/1992 | Moldovan et al. | 218/40 |
| 5,138,122 | 8/1992 | Moldovan et al. | 218/22 |
| 5,416,455 | 5/1995 | Moldovan et al. | 335/132 |
| 5,418,511 | 5/1995 | Theisen et al. | 335/201 |

*Primary Examiner*—J. R. Scott
*Attorney, Agent, or Firm*—Quarles & Brady

[57] ABSTRACT

A contactor for switching electric current has a stationary contact and a movable contact which when driven by a solenoid moves into and away from abutment with the stationary contact. An arc chute includes a plurality of splitter plates which extend radially from a center point in a geometric arc around the stationary contact on a side that is opposite to the movable contact. A curved arc runner is connected to the stationary contact to guide an electrical arc travelling between the stationary contact and each of the splitter plates. An elongated arc runner is connected to the movable contact to guide the electrical arc between the movable contact and splitter plates at the ends of the geometric arc.

19 Claims, 4 Drawing Sheets

ELECTRIC SWITCH WITH ARC CHUTE, RADIALLY CONVERGING ARC SPLITTER PLATES, AND MOVABLE AND STATIONARY ARC RUNNERS

BACKGROUND OF THE INVENTION

This invention relates to apparatus for switching electric current, such as direct current (DC) electric power; and more particularly to such apparatus which has a mechanism for extinguishing arcs formed between switch contacts during separation.

DC power is used in a variety of applications such as battery powered systems, drives for DC motors and DC accessory circuits. Contactors typically are provided between the DC supply and the load to apply and remove electric power to the load. Weight, reliability and high DC voltage switching and interrupting capability are important considerations in developing the contactor. Furthermore, in many applications relatively high direct currents must be switched which produce arcs when the contacts of the contactor are opened, thereby requiring a mechanism for extinguishing the arcs.

For example, contactors are employed to control the application of direct current to a motor in electric vehicles. Although the current conducts in one direction between the source and the electric motor when the electric motors are driving the wheels, electrically powered vehicles also have a regeneration mode in which the current conducts in the opposite direction when the wheels are not being driven by the motor. Regenerative braking is used in other motor systems, such as overhead cranes and transit cars, to slow the apparatus by directing energy to an absorbing or dissipating device. Thus, it is preferred that the contactor between the DC power source and the motor be capable of handling currents in both directions at high DC voltage and extinguishing arcs which may occur regardless of the direction of that current.

SUMMARY OF THE INVENTION

A general object of the present invention is to provide an improved switching apparatus for electric current.

Another object is to provide a current switching apparatus with a mechanism that extinguished arcs that form while the switch contacts separate.

A further object is to perform the switching without any arc by-products, such as flames, extending beyond the enclosure of the apparatus.

Yet another object is to provide an apparatus for switching direct currents of either polarity.

These and other objects are fulfilled by an electric current switching apparatus that includes a pair of terminals with a stationary contact electrically connected to one power terminal. A movable contact is electrically connected to the other power terminal and is located to one side of the stationary contact. An arc chute has a plurality of splitter plates extending radially from a center point in a geometric arc which extends around the stationary contact on a side that is opposite to the one side. In essence the arc chute is bent around the remote side of the stationary contact from the movable contact.

In the preferred embodiment, a D-shaped stationary arc runner has a straight portion of the D connected to the stationary contact and a curved portion which faces the plurality of splitter plates. The curved portion is aligned so that an electrical arc is able to travel between the stationary arc runner and the rounded edges of the plurality of splitter plates. In addition, a movable arc runner preferably is connected to the movable contact and has arms extending toward each end of the geometric arc of splitter plates so that an electrical arc can travel between the arms and splitter plates at the ends of the geometric arc. L-shaped end conductors may be utilized to aid the electrical arc in traveling to the splitter plates at the ends of the geometric arc.

DETAILED DESCRIPTION OF THE INVENTION

Figure 1:
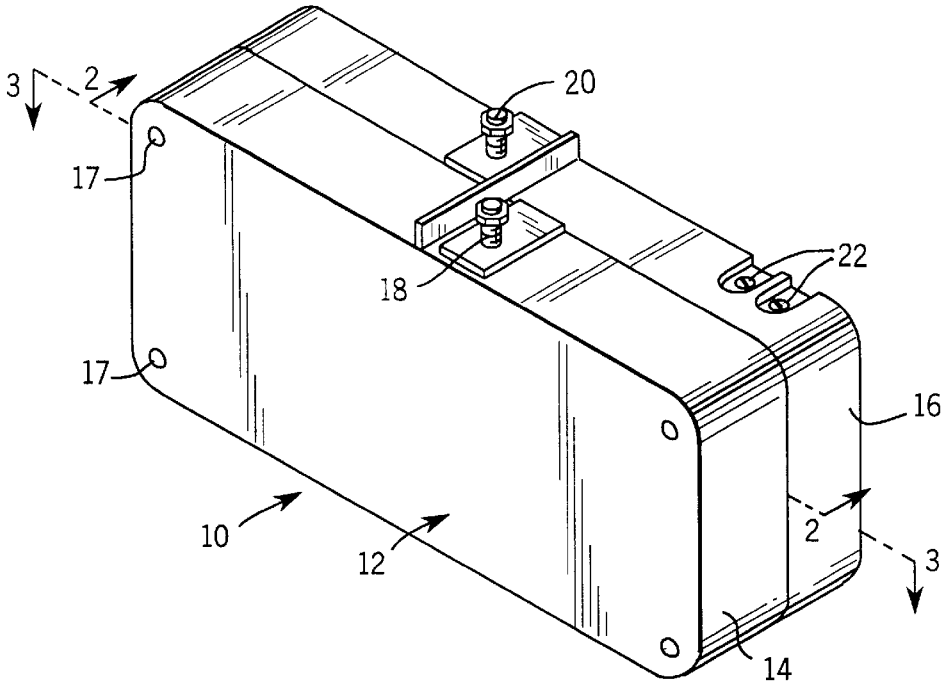
FIG. 1 is an isometric view of a direct current contactor according to the present invention.

With reference to FIG. 1, a sealed electromagnetic single pole contactor 10 has a plastic housing 12 formed by two substantially mirror image shells 14 and 16 formed of insulating plastic material. The shells are held together by four rivets 17 to encapsulate a bi-directional DC switch mechanism within the housing. The first shell 14 has a first power terminal 18, while the second shell 16 has a second power terminal 20 and a pair of recessed terminals 22 for a solenoid which opens and closes the electrical switch contacts inside housing 12. With the switch closed, direct current conducts between the power terminals 18 and 20.

Figure 2:
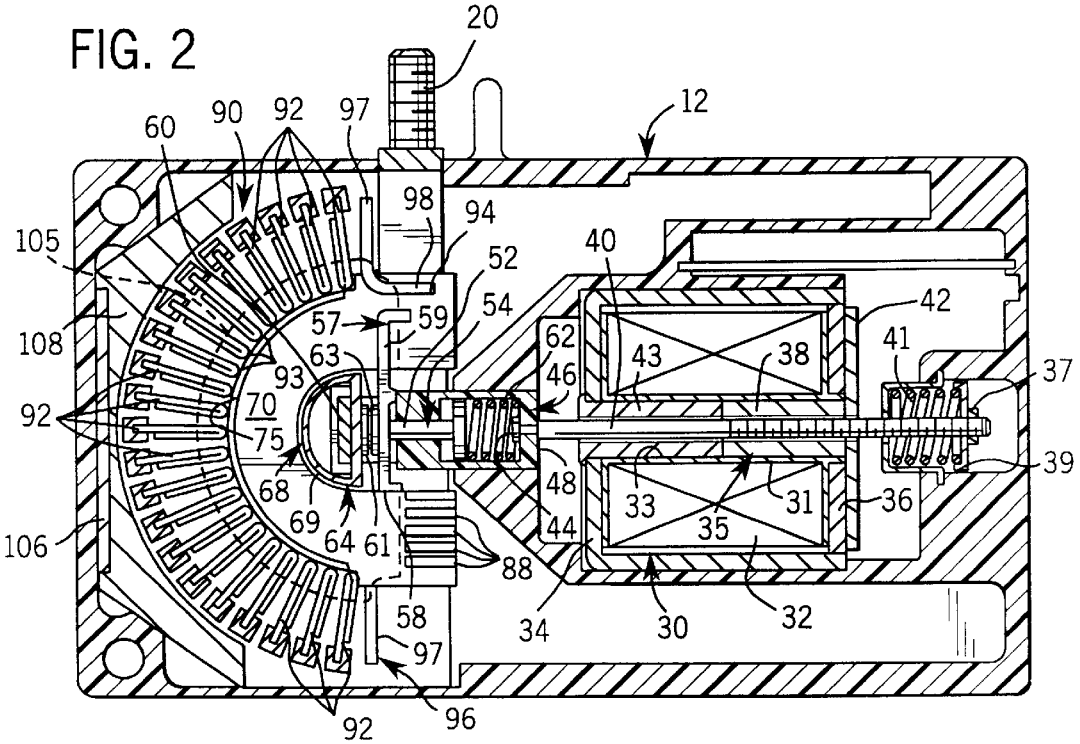
FIG. 2 is a vertical cross sectional view along line 2—2 of FIG. 1.
Figure 3:
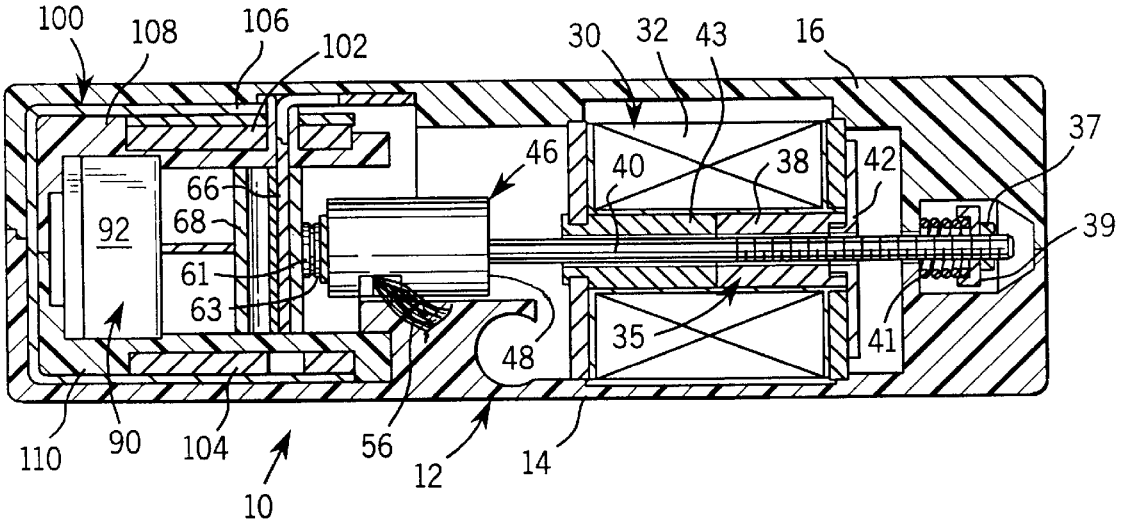
FIG. 3 is a horizontal cross sectional view along line 3—3 of FIG. 1.
Figure 5:
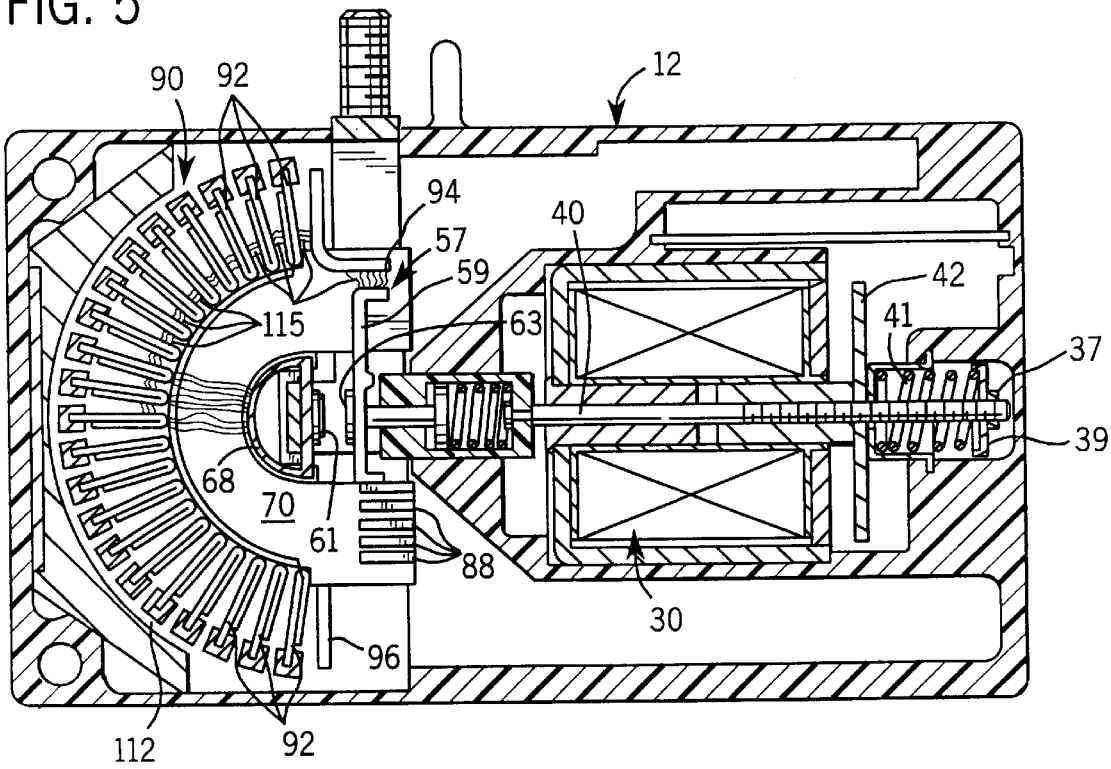
FIG. 5 is a vertical cross sectional view similar to FIG. 2 with the switch contacts in an open state.

With reference to FIGS. 2 and 3, inside the contactor 10 is an electromagnetic solenoid 30 which nests in grooves in the interior surfaces of housing shells 14 and 16. The solenoid 30 has an annular coil 32 within a U-shaped metal frame 34 which is closed by a metallic end plate 36. Wires from the solenoid coil 32 connect to recessed terminals 22. The solenoid coil 32 has a central opening 33 with a non-magnetic sleeve 31 that prevents magnetic sticking of an armature 35 located within the central opening. The armature 35 has a shaft 40 with a nut 37 and a spring retainer 39 attached at one end and engaging a spring 41 that biases the armature 35 so that the contactor 10 is in a normally open position as illustrated in FIG. 5. FIG. 3 depicts the contactor 10 in the closed state with the solenoid energized to move the armature 35 leftward. The armature 35 further comprises a metallic plunger 38 attached along with a disk 42 to an intermediate section of the armature shaft 40. The plunger 38 is located in one end portion of the sleeve 31 and has a length approximately equal to one-half the length of the coil's central opening 33. The armature shaft 40 passes freely through a magnetic core 43 in the other half of the central opening 33. The magnetic core 43 is fixed to the solenoid frame 34 by riveting over a reduced diameter end of the core that extends through an hole in the frame. The armature shaft 40 projects through that hole in the solenoid frame 34 and terminates with head 44 at the remote end.

The armature shaft head 44 engages an actuator 46 formed of electrically insulating material, such as plastic.

Specifically, the head 44 is captured within a slot in one end wall 48 of the hollow actuator 46. The opposing end wall of actuator 46 has an opening 65 (FIG. 6A) that receives a shaft 52 of a movable contact 54 that is connected by a copper braid 56 to power terminal 18 as visible in FIG. 3. The details of the movable contact 54 also are shown as an exploded view in FIG. 4. The remote end of the contact shaft 52 is attached to the middle of an elongated, copper arc runner 57 with a pair of vertical arms 58 and 59 offset horizontally on opposite sides of the contact shaft 52 in the orientation illustrated in FIG. 4. The arc runner arms 58 and 59 have end portions bent toward the solenoid 30 to form flanges 60. The opposite side of the movable arc runner 57 from the contact shaft 52 has a first contact pad 63, shown in FIGS. 2 and 3. The movable contact 54 is biased by a coil spring 62 away from the end wall 48 of the actuator 46.

In the closed state of contactor 10, the first contact pad 63 of the movable contact 54 is forced by the solenoid 30 against a second contact pad 61 on a stationary contact 64. The armature shaft 40 pushes on the actuator 46 compressing coil spring 62 and establishing contact force throughout wear of the contact pads 61 and 63.

Figure 6A:
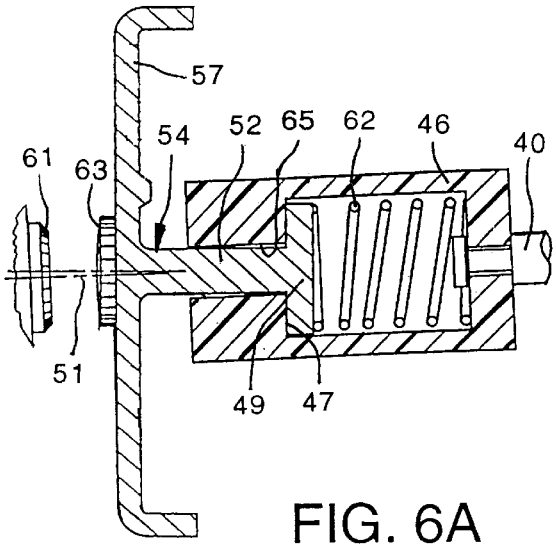
FIGS. 6A–6D depict the wiping action of the switch contacts in four positions as the contacts close.
Figure 6B:
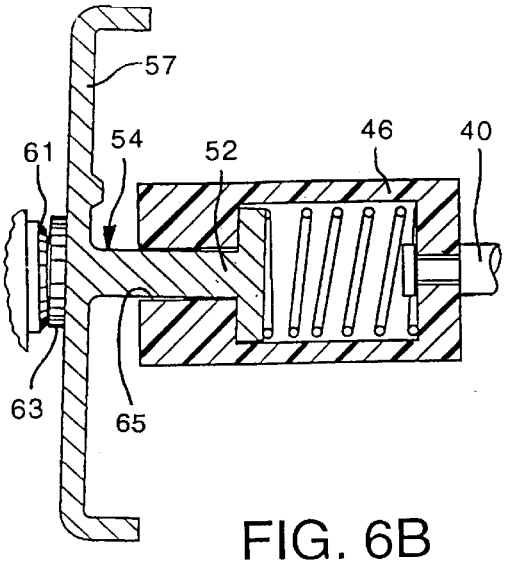
Figure 6C:
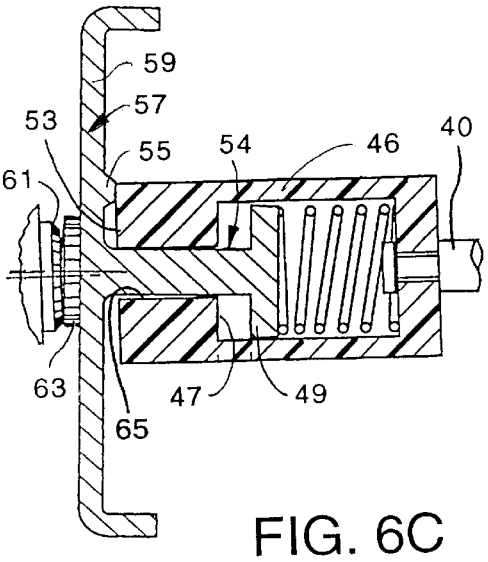
Figure 6D:
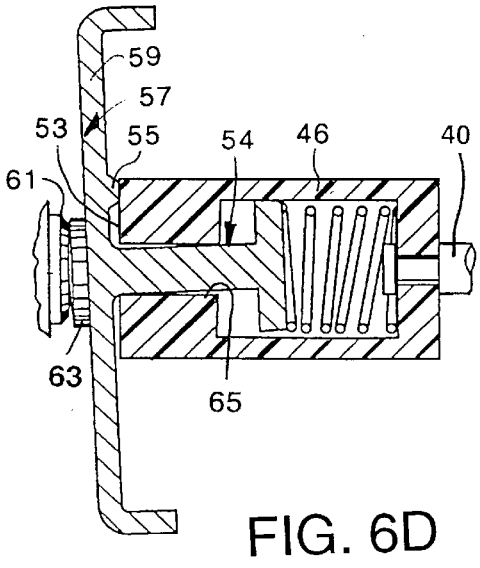

The actuator 46 is designed so that this action inherently wipes the surfaces of the two contact pads 61 and 63. As shown in FIG. 6A, when the contacts are open a head 49 on the tubular shaft 52 of movable contact 54 is forced against interior surface 47 of actuator 46 by spring 62. This interior surface 47 is angled so as not to be orthogonal with respect to the center line of the fixed second contact pad 61. Thus the axis of the movable contact shaft 52 is not aligned with the first contact pad center line as indicated by lines 51. When the solenoid 30 is energized, the actuator 46 and moveable contact 54 move toward the stationary contact 64 until first contact pad 63 strikes the second contact pad 61 as illustrated in FIG. 6B. Thereafter, further movement of the solenoid armature 35 continues to push the actuator toward second contact pad 61 as shown in FIG. 6C. Nevertheless, the first contact pad 63 stays relatively motionless due to abutment with the fixed second contact pad 61. Note that the head 49 of the movable contact shaft 52 now has moved away from the internal surface 47 of the actuator and that a rib 55 on the movable arc runner 57 begins to abut the actuator. At this point the movable contact shaft 52 still is out of alignment with the first contact pad center line. However, further movement of the solenoid armature shaft 40 forces the actuator 46 against the rib 55 causing the movable contact 54 to pivot within the aperture in the actuator into a position shown in FIG. 6D. The pivoting results in the surface of the moving first contact pad 63 wiping across the surface of the stationary second contact pad 61. That wiping action cleans those surfaces.

Figure 4:
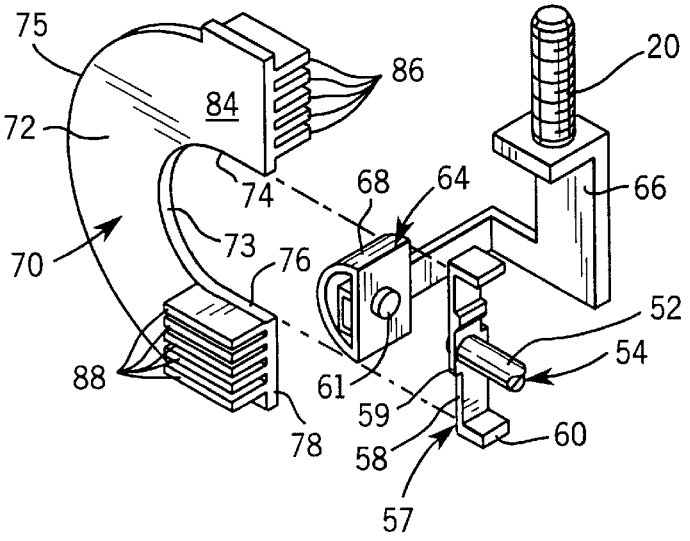
FIG. 4 is an isometric exploded view of electrical contacts and an insulator utilized inside the contactor.

Referring again to FIGS. 2 and 4, a rigid metal strap 66 connects the second contact pad 61 to the other power terminal 20. Stationary contact 64 has a copper, D-shaped stationary arc runner 68 through which an end of the strap 66 extends and is welded to the straight portion 67 of the D. An insulator 70 has a U-shaped plate 72 that extends around the stationary contact 64 with the curved portion 69 of the D-shaped stationary arc runner 68 being adjacent to a curved inside edge 73 of the insulator. The two straight legs 74 and 76 of the insulator plate 72 project on opposite sides of the movable contact 54 and actuator 46. With particular reference to FIG. 4, arm 58 of the movable arc runner 57 is located on a first side 78 of the plate 72 of insulator 70 and the other offset arm 59 is positioned on the opposite second side 84 of the insulator plate. A first series of five walls 86 is on the first side 78 of the insulator plate 72 along the first straight leg 74; and a second series of five walls 88 is on the second side 84 of the plate 72 along the second straight leg 76. The walls 86 and 88 are on the opposite sides of the respective plate legs 74 and 76 from the side adjacent to the arms 58 and 59 of the movable arc runner 57 (see FIG. 2).

Referring again to FIGS. 2 and 3, a novel arc chute 90 is positioned in the housing 12 around the outer curved edge 75 of the insulator 70 to extinguish arcs that form as the contact pads 61 and 63 separate. Arc chute 90 is formed by 21 splitter plates 92 of a non-ferrous, electrically conductive material, such as copper. The splitter plates 92 are positioned radially in a semi-circular array about a center located at the point of contact between the two contact pads 61 and 63. Note also that this point is the center of the radius for the curved portion of the insulator 70 and the curved portion 69 of stationary arc runner 68. The splitter plates 92 are J-shaped with the rounded edges 93 facing the contacts 54 and 64 and equidistantly spaced from the center surface of the curved portion 69 of the stationary arc runner 68. As is apparent in FIG. 3 the splitter plates 92 extend on both sides of the insulator plate 72 which is located midway along the rounded edge of each splitter plate. L-shaped, copper end pieces 94 and 96 are positioned at the ends of the semi-circular array of splitter plates 92 and have one leg 97 which forms another element of the array and an orthogonal leg 98 that is parallel to the direction of the contact movement. In essence, the arc chute 90 is arranged in a geometric arc, a semicircle, around the remote side of the stationary contact 64 from the movable contact 54. With reference to FIG. 5, a gas vent 112 at each of the splitter plates provides a passage for the arc gases to escape between the splitter plates and at the rear of the arc chute 90, thus relieving the gas pressure from interfering with the arc 115 running across the rounded edges 93 of the splitter plates.

Because the contactor 10 switches direct current, a magnetic field is required to move electric arcs into the arc chute 90. Referring to FIG. 3, that magnetic field is produced across the arc chute 90 by a permanent magnet assembly 100. This assembly comprises a separate permanent magnet 102 and 104 on opposite sides of the arc chute 90 along the interior surfaces of the housing shells 14 and 16 between the contacts 61 and 63 and the arc chute 90. Each permanent magnet has a semicircular shape as shown by dashed line 105 in FIG. 2. The two permanent magnets 102 and 104 are magnetically coupled by a steel, U-shaped member 106 that abuts the outside surface of each permanent magnet and extends around the end of the arc chute 90 that is remote from the contact pads 61 and 63. A pair of plastic brackets 108 and 110 with notches therein hold the arc chute splitter plates 92 and permanent magnets 102 and 104 in alignment within the U-shaped member 106. The coupling of the permanent magnets 102 and 104 establishes a magnetic field across the arc chute 90 (vertically in FIG. 3), which directs electric arcs formed between the contact pads 61 and 63 toward the splitter plates 92, as will be described.

With reference to FIG. 2, when the contactor 10 opens the electrical contact pads 61 and 63, the plunger 38 moves toward the right, out of the solenoid coil 32. This motion is transferred by the armature shaft 40 and actuator 46 to the movable contact 54 causing the first contact pad 63 to move away from the second contact pad 61 on the stationary contact 64. At the end of this travel, the movable contact 54 and armature 35 are positioned as illustrated in FIG. 5.

As the contact pads 61 and 63 separate, an arc 115 may form therebetween. The force produced by the interaction of the arc current with the magnetic field from the permanent magnets 102 and 104 causes the arc 115 to move from the first contact pad 63 outward along the movable arc runner 57 toward one of the L-shaped end pieces 94 and 96 of the arc chute 90. Toward which end piece 94 or 96 the arc moves is determined by the direction of the current flow between the two contact pads 61 and 63. Assume for example that the arc travels along arc runner arm 59 toward end piece 94 in FIG. 5. At the same time the arc 115 moves off the second contact pad 61 and onto the stationary arc runner 68. As the contact pads 61 and 63 continue to separate, the arc propagates to the end of arm 59 of the movable arc runner 57 and stretches outward until reaching the arc chute 90.

So thereafter the arc 115 bridges the gap between the L-shaped end piece 94 and the adjacent splitter plate 92. Then the arc begins propagating to each subsequent splitter plate 92 around the semi-circular array while remaining established between the movable arc runner 57 and end piece 94. This action forms a separate sub-arc in the gap between adjacent splitter plates 92. The leading end of the arc travels around the curved outer surface of the stationary arc runner 68. Eventually the arc 115 spans a sufficient number of gaps between the splitter plates 92 building up sufficient arc voltage and extinguishing the arc.

As the arc propagates around the entire arcuate arc chute 90 between the two end plates 94 and 96 building up arc voltage, walls 88 on insulator 70 act as gas cooling fins preventing the arc from jumping to the other end of the movable arc runner 57. The walls 88 also prevent arc voltage collapse inhibiting the arc 115 from reinitiating its motion down the movable arc runner 57 to end plates 94 and 96.

The present arc chute is intrinsically non-polarized (bidirectional) due to the symmetry of the arc runner and splitter plate arrangement. This design enables one set of splitter plates to handle arcs running in both directions from the contact and allows each splitter plate to have sufficient mass to make inductive load (long arc duration) switching possible without damage to the plates.

We claim:

1. An electric current switching apparatus comprising:

first and second power terminals;

a stationary contact electrically connected to the second power terminal;

a movable contact electrically connected to the first power terminal and located on a first side of the stationary contact;

an arc chute having a plurality of electrically conductive splitter plates extending around the stationary contact on a second side that is opposite to the first side, wherein the splitter plates extend radially from a center point in a geometric arc about the center point; and a magnet fixedly located adjacent to the stationary contact and the movable contact to establish a magnetic field that causing an electric arc to move into the arc chute.

2. The electric current switching apparatus as recited in claim 1 wherein each one of the plurality of splitter plates has a rounded edge facing the stationary contact.

3. The electric current switching apparatus as recited in claim 1 further comprising a stationary arc runner connected to the stationary contact and having a curved surface facing the plurality of splitter plates.

4. The electric current switching apparatus as recited in claim 3 wherein the geometric arc and the curved surface of the stationary arc runner are semicircular.

5. The electric current switching apparatus as recited in claim 1 further comprising a stationary arc runner having a D-shape with a straight portion of the D-shape connected to the stationary contact and a curved portion of the D-shape spaced from and facing the plurality of splitter plates.

6. The electric current switching apparatus as recited in claim 1 further comprising a movable arc runner connected to the movable contact, and extending between ends of the geometric arc of splitter plates.

7. The electric current switching apparatus as recited in claim 1 further comprising a first end conductor positioned at one end of the geometric arc of splitter plates; and a second end conductor positioned at one end of the geometric arc; wherein each of the first and second end conductors is L-shaped with one leg having a surface facing one of the plurality of splitter plates and with another leg having a surface facing the stationary and movable contacts.

8. The electric current switching apparatus as recited in claim 1 further comprising an insulator plate having a U-shape with a curved section and two extensions, wherein the curved section has an outer curved edge adjacent to the geometric arc of splitter plates, and the stationary and movable contacts are located between the two extensions.

9. The electric current switching apparatus as recited in claim 8 further comprising movable arc runner connected to the movable contact, and the movable arc runner having a first arm extending from the movable contact toward one end of the geometric arc of splitter plate on one side of the insulator plate and having a second arm extending from the movable contact toward another end of the geometric arc of splitter plates on an opposite side of the insulator plate.

10. The electric current switching apparatus as recited in claim 9 wherein the insulator plate has a first surface on the one side with a first barrier projecting from the first surface between the other end of the geometric arc of splitter plates and the movable contact, and a second surface on the opposite side with a second barrier projecting from the second surface between the one end of the geometric arc of splitter plates and the movable contact.

11. The electric current switching apparatus as recited in claim 10 wherein the first barrier is formed by a first plurality of walls each extending transverse to a line between the other end of the geometric arc of splitter plates and the movable contact; and the second barrier is formed by a second plurality of walls each extending transverse to another line between the one end of the geometric arc of splitter plates and the movable contact.

12. The electric current switching apparatus as recited in claim 10 wherein the first barrier and the second barrier each are formed by a plurality of walls.

13. The electric current switching apparatus as recited in claim 1 wherein the movable contact has a shaft with a head at one end, the staff having a longitudinal axis which is misaligned with a line extending orthogonally from a surface of the stationary contact; and further comprising an actuator having an aperture extending into a cavity that has an internal surface, the shaft extends through the aperture and a spring biases the head against the internal surface, wherein the longitudinal axis and the second longitudinal axis are misaligned so that movement of the actuator causes the moveable contact to abut the stationary contact and thereafter further movement causes the shaft to pivot within the aperture resulting in wiping action between the movable and stationary contacts.

14. An electric current switching apparatus comprising:

first and second power terminals;

a stationary contact electrically connected to the second power terminal;

a stationary arc runner connected to the stationary contact and having a curved surface on a first side of the stationary contact;

a movable contact electrically connected to the first power terminal and located on a second side of the stationary contact;

a plurality of splitter plates with rounded edges located on an arcuate line that is equidistantly spaced from the curved surface of the stationary arc runner; and a magnet fixedly located adjacent to the stationary contact and the movable contact to establish a magnetic field that causing an electric arc to move into the plurality of splitter plates.

15. The electric current switching apparatus as recited in claim 14 wherein the plurality of splitter plates are located in different planes which intersect the curved surface.

16. The electric current switching apparatus as recited in claim 14 wherein the arcuate line is a semicircle.

17. The electric current switching apparatus as recited in claim 14 further comprising a movable arc runner connected to the movable contact, and having a first arm extending toward one end of the arcuate line on which the rounded edges of the plurality of splitter plates are located and having a second arm extending toward another end of the arcuate line.

18. The electric current switching apparatus as recited in claim 17 further comprising an insulator plate having a U-shape with a curved section and two straight sections, the curved section having an outer curved edge adjacent to the rounded edges of the plurality of splitter plates, and the stationary and movable contacts located between the two straight sections; and wherein the first arm of the movable arc runner extends on one side of the insulator plate and the second arm of the movable arc runner extends on an opposite side of the insulator plate.

19. The electric current switching apparatus as recited in claim 18 wherein the insulator plate has a first surface on the one side with a plurality of walls projecting from the first surface between the other end of the arcuate line and the movable contact, and has a second surface on the opposite side with a second plurality of walls projecting from the second surface between the one end of the arcuate line and the movable contact.

* * * * *